United States Patent [19]

Lee

[11] 4,029,478

[45] June 14, 1977

[54] ZN-AL HOT-DIP COATED FERROUS SHEET

[75] Inventor: Harvie Ho Lee, Glenwood, Ill.

[73] Assignee: Inland Steel Company, Chicago, Ill.

[22] Filed: Jan. 5, 1976

[21] Appl. No.: 646,530

[52] U.S. Cl. ..... 428/659; 427/433

[51] Int. Cl.[2] ..... B32B 15/18; B32B 15/20

[58] Field of Search ..... 29/196.5, 196.2; 427/433

[56] References Cited

UNITED STATES PATENTS

| | | | |
|---|---|---|---|
| 2,824,021 | 2/1958 | Cook et al. | 427/433 |
| 3,056,694 | 10/1962 | Mehler et al. | 427/433 |
| 3,245,765 | 4/1966 | Lawson | 423/433 |
| 3,320,040 | 5/1967 | Roe et al. | 29/196.5 |
| 3,505,043 | 4/1970 | Lee et al. | 29/196.2 |

*Primary Examiner*—Arthur J. Steiner

*Attorney, Agent, or Firm*—Hibben, Noyes & Bicknell, Ltd.

[57] ABSTRACT

A ferrous metal strip is continuously hot-dip coated with a zinc-aluminum alloy by immersing the metal strip in a hot-dip coating bath containing between about 0.2 wt. percent and 17 wt. percent aluminum, between about 0.02 wt. percent and 0.15 wt. percent lead, and between about 0.03 wt. percent and about 0.15 wt. percent magnesium with the balance essentially zinc. In a further embodiment the hot-dip alloy coating can also contain between about 0.1 wt. % and 0.3 wt. % copper. The resulting hot-dip zinc-aluminum alloy coatings when applied to a ferrous metal strip exhibit good resistance to intergranular corrosion and blistering when exposed to a high humidity atmosphere and form smooth surface coatings which have good formability both in the "as coated" state and after prolonged storage in a high humidity atmosphere.

6 Claims, 7 Drawing Figures

ZN-AL HOT-DIP COATED FERROUS SHEET

Figure 1:
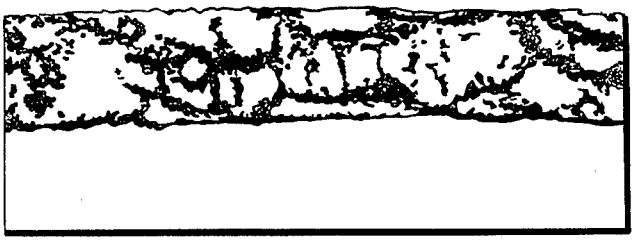

The present invention relates generally to a zinc-aluminum alloy coated ferrous metal strip and more particularly to a ferrous metal strip having a smooth zinc-aluminum alloy hot-dip coating which exhibits improved resistance to intergranular corrosion when exposed for prolonged periods to a high humidity atmosphere and which is further characterized by good paintability and formability properties and the absence of blisters both before and after prolonged exposure to a high humidity atmosphere.

In a continuous process of producing hot-dip galvanized sheet material in which an endless ferrous metal strip is continuously passed through a molten bath comprised mainly of metallic zinc so as to protect the ferrous metal against corrosion, it has been found advantageous to include at least a small amount of aluminum in the zinc bath. Thus, adding from 0.15 to 0.3 wt. % aluminum to a zinc hot-dip galvanizing bath prevents forming a thick intermetallic layer on the ferrous metal surface and improves the formability of the coated strip. It has also been found that adding larger amounts of aluminum to the zinc coating bath (i.e. from about 4 wt. % up to about 17 wt. %) further improves the resistance of the coating to surface corrosion without interferring with good formability. The addition of other alloying metals, such as magnesium, to a zinc-aluminum hot-dip coating bath has also been disclosed for improving certain properties of zinc-aluminum hot-dip coatings (see Roe et al U.S. Pat. No. 3,320,040 and Lee et al U.S. Pat. No. 3,505,043.

When an endless steel strip is hot-dip coated with a zinc or a zinc-aluminum alloy in a modern continuous coating line, particularly when coating at relatively low line speeds, the fluidity of the bath is such that it is difficult to form a smooth, ripple-free hot-dip coating having good paintability properties and an attractive appearance, particularly when the bath contains magnesium. In order to obtain a smooth, attractive hot-dip coating it has heretofore been considered necessary to include in the zinc-aluminum hot-dip coating bath a small but definite amount of lead to impart to the bath the required low surface tension so that a smooth ripple-free coating will be formed. In order to form a smooth hot-dip coating at least 0.06 wt. % lead is required in a hot-dip coating bath containing between about 0.2 wt. % and about 17 wt. % aluminum with the balance being essentially zinc and with at least about 0.1 wt. % lead being used in commercial practice. Zinc-aluminum alloys containing over 17.5 wt. % aluminum have a primary phase which behaves essentially as pure aluminum. The latter zinc-aluminum alloy coatings exhibit poor formability and poor coating adherence and hot-dip coatings which are not smooth and, therefore, are not suitable for coating ferrous metal strips which must have good formability properties and paintability. The addition of lead to the coating baths enhances the formation of spangles, particularly in the zinc coatings containing a small amount of aluminum (i.e. around 0.2 wt. % aluminum), and decreases paintability.

It has been found, moreover, that when a ferrous metal base is coated with a zinc-aluminum alloy hot-dip coating which contains more than about 0.02 wt. % lead and is exposed to a high humidity atmosphere for a prolonged period, as frequently occurs during normal storage, the surface of the hot-dip coating may appear entirely normal but the strip cannot be fabricated by deforming without having the coating separate from the base. Furthermore, when these zinc-aluminum hot-dip coating baths contain the minimum amount of lead required to provide a smooth ripple-free surface (i.e. at least 0.06 wt. % lead), pronounced blisters are formed on the surface of the coating, particularly along the grain boundaries, after the coated strip is exposed for a prolonged period to a high humidity atmosphere. These blisters were found to be the result of extensive intergranular corrosion which has caused localized lifting of the hot-dip coating. And, while the zinc-aluminum alloy coatings containing in excess of 0.02 wt. % lead and a relatively high concentration of aluminum (i.e. between about 4 wt. % and 17 wt. % aluminum) are particularly susceptible to intergranular corrosion, the entire range of zinc-aluminum alloy hot-dip coatings containing between about 0.2 wt. % to about 17 wt. % aluminum in the presence of more than 0.02 wt. % lead are subject to attack by intergranular corrosion which results in poor formability properties and which can cause surface blistering on prolonged exposure to a high humidity atmosphere.

While the zinc-aluminum alloy hot-dip coatings on a ferrous metal strip which are substantially lead-free (i.e. have a lead content below about 0.002 wt. % lead) do not exhibit intergranular corrosion or blistering when exposed to a high humidity atmosphere for a prolonged period, it is not practical to maintain the lead content of a hot-dip coating bath below 0.002 wt. %. Moreover, when the lead content of a zinc-aluminum alloy hot-dip coating bath is reduced to about 0.05 wt. % and below, the surface tension of the bath is such that the hot-dip coating applied on a continuous coating line has objectionable ripples, and the surface of the resulting hot-dip coating is not sufficiently smooth to satisfy the trade requirements for paintability, for example. Thus, there remains the problem of providing a zinc-aluminum alloy hot-dip coating having both a smooth bright surface and good resistance to intergranular corrosion when exposed to a high humidity atmosphere for a prolonged period.

It is therefore an object of the present invention to provide a ferrous metal sheet having a smooth zinc-aluminum alloy coating with improved resistance to intergranular corrosion.

It is a further object of the present invention to provide an improved zinc-aluminum alloy hot-dip coating bath and process for providing smooth zinc-aluminum alloy hot-dip coated ferrous metal strips having good resistance to intergranular corrosion.

It is also an object of the present invention to provide an improved zinc-aluminum alloy hot-dip coating and coating bath and a continuous process for hot-dip coating a ferrous metal strip with a smooth zinc-aluminum alloy coating having improved resistance to intergranular corrosion and blistering caused by intergranular corrosion on exposure for a prolonged period to a high humidity atmosphere.

It is still another object of the present invention to provide a method of significantly reducing intergranular corrosion in a zinc-aluminum alloy coating on a ferrous metal strip wherein the coating contains a significant amount of lead.

Figure 2:
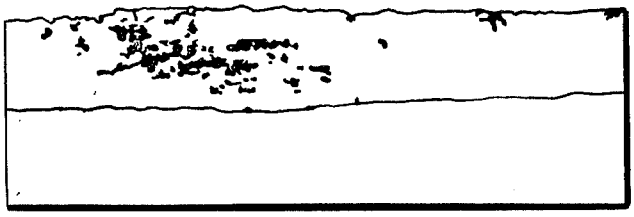
Figure 3:
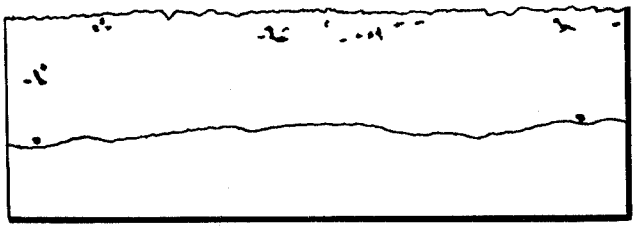
Figure 4:
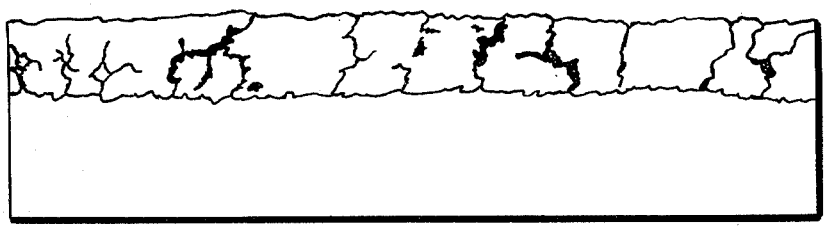
Figure 5:
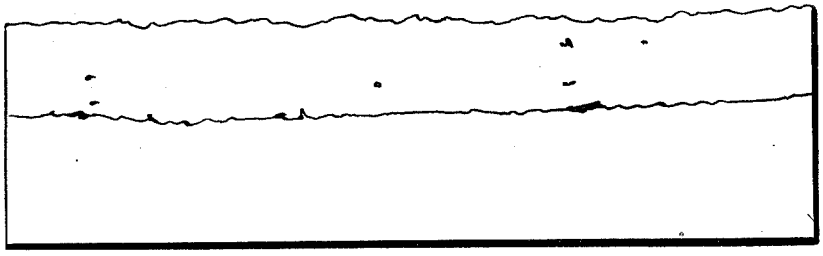
Figure 6:
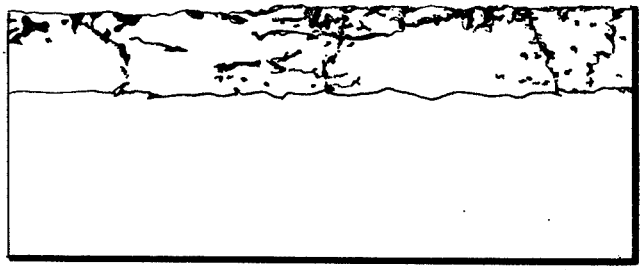
Figure 7:
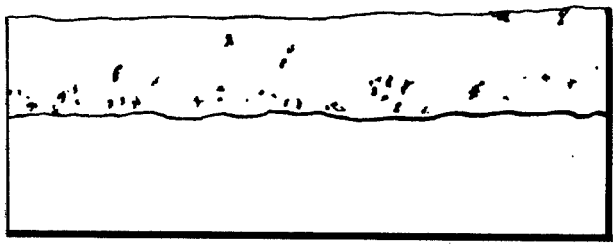

Other objects of the present invention will be apparent from the detailed description and claims to follow when read in conjunction with the accompanying drawing, wherein:

FIG. 1 is a schematic vertical sectional view of the microstructure at 750× magnification of an unetched hot-dip alloy coating on a rimmed steel panel wherein the alloy coating is a 5 wt. % aluminum-zinc eutectic alloy which contains 0.06 wt. % lead after the coated panel has been exposed for 5 days at 176° F (80° C) to a 92% relative humidity atmosphere;

FIG. 2 is a schematic vertical sectional view of the microstructure at 750× magnification of an unetched hot-dip 5 wt. % aluminum-zinc alloy coating on a rimmed steel panel wherein the alloy coating contains 5 wt. % aluminum, 0.06 wt. % lead and 0.1 wt. % magnesium with the balance essentially zinc after the panel has been exposed to the high humidity atmosphere used on the panel of FIG. 1;

FIG. 3 is a schematic vertical sectional view of the microstructure at 750× magnification of an unetched hot-dip alloy coated rimmed steel panel in which 0.3 wt. % copper was added to the coating composition of FIG. 2 and the panel exposed to the same high humidity atmosphere as in FIG. 2;

FIG. 4 is a schematic vertical sectional view of the microstructure at 500× magnification of an unetched 28 gauge full-hard rimmed steel panel continuously hot-dip coated with a 5 wt. % aluminum-zinc alloy containing 0.06 wt. % lead with the balance essentially zinc after about 15 months indoor storage under normal atmospheric conditions;

FIG. 5 is a schematic vertical sectional view of the microstructure at 500× magnification of an unetched 28 gauge full-hard rimmed steel panel continuously hot-dip coated with a 5 wt. % aluminum-zinc alloy coating containing 0.06 wt. % lead and 0.1 wt. % magnesium with the balance essentially zinc after the strip has remained in indoor storage under normal atmospheric conditions for 12 months;

FIG. 6 is a schematic vertical sectional view of an unetched hot-dip coated rimmed steel panel showing the microstructure at 600× magnification after exposure for 2 weeks at 176° F (80° C) to a 92% relative humidity atmosphere wherein the hot-dip coating is a 0.2 wt. % aluminum-zinc alloy, containing 0.1 wt. % lead with the balance essentially zinc; and FIG. 7 is a schematic vertical sectional view of the microstructure at 600× magnification of an unetched hot-dip coated rimmed steel panel wherein the coating is a 0.2 wt. % aluminum-zinc alloy which contain 0.1 wt. % lead, 0.1 wt. % magnesium, 0.3 wt. % copper with the balance essentially zinc after two weeks exposure at 176° F (80° C) to a 92% R. H. atmosphere.

It has been discovered that the above described highly objectionable intergranular corrosion, which occurs in zinc-aluminum alloy coatings containing between about 0.2 and about 17 wt. % aluminum when the lead content is in excess of 0.02 wt. % lead and not substantially above about 0.15 wt. % lead, can be significantly reduced by adding a small amount of magnesium to the zinc-aluminum alloy coating baths. And, whereas one familiar with the effect of adding magnesium to a zinc base coating would expect that adding the magnesium to such an aluminum-zinc alloy coating would adversely affect the uniformity and the smoothness of the coating, there is no adverse effect on the coatability and appearance as a result of adding a small amount of magnesium in accordance with the present invention to a zinc-aluminum alloy coating containing aluminum, particularly when the aluminum content is between about 4 and 17 wt. %, and lead in the herein indicated amounts is present when the coating is applied to a ferrous metal strip by suitable hot-dip continuous coating procedures.

More particularly, it has been found that by the addition of between about 0.03% and 0.10% by wt. magnesium to the zinc-aluminum alloy hot-dip coating bath containing between about 0.2 wt. % and about 17 wt. % aluminum and containing lead in an amount between about 0.02 wt. % and up to about 0.15 wt. %, it is possible to substantially retard intergranular corrosion and blistering which occurs in the coatings due to the presence of lead when the coating is exposed to a high humidity atmosphere for prolonged periods. Since intergranular corrosion and blistering are more prevalent in those zinc-aluminum alloy hot-dip coatings which contain relatively large amounts of aluminum (i.e. at least 4 wt. % and above), the beneficial effect of magnesium additions is more evident and, in relative terms, is more beneficial in the zinc-aluminum alloy coatings containing between 4 and 17 wt. % aluminum. And, the poor coating properties of an aluminum-zinc alloy hot-dip coating bath normally encountered when even small amounts of magnesium are added to a zinc-base hot-dip coating bath, and which becomes particularly objectionable when hot-dip coating at a relatively low line speed, are substantially eliminated, particularly with the zinc-aluminum alloy coatings containing between 4 and 17 wt. % aluminum and between 0.06 and 0.15 wt. % lead.

In a further embodiment of the present invention, resistance to intergranular corrosion in the 0.2–17 wt. % aluminum-zinc alloy coatings containing from about 0.02 wt. % up to about 0.15 wt. % lead can be further minimized by incorporating copper in an amount between about 0.1% and 0.3 wt. % in combination with magnesium in the above described amounts. When the zinc-aluminum alloy coating does not contain magnesium, the addition of copper to the coating in the maximum amount which can be tolerated (i.e. only about 0.3 wt. % copper can be used, since any amount of copper added in excess of about 0.3 wt. % causes undesirable embrittlement of the aluminum-zinc alloy coating) has no appreciable beneficial effect on the formability and resistance to intergranular corrosion of the coating. The addition of both magnesium and copper in combination in the herein indicated amounts to a lead-containing zinc-aluminum alloy coating substantially retards intergranular corrosion of the alloy coating on a steel sheet.

In order to further illustrate the present invention a series of 0.2 wt. % and about 5.0 wt. % aluminum-zinc alloy hot-dip coating baths were prepared by adding pure alloying elements to pure zinc spelter which was saturated with iron (i.e. to provide about 0.02 wt. % iron which corresponds to the normal iron build-up in a continuous hot-dip galvanizing bath due to continuous contact with the steel strip) so that the coating baths had an alloy composition of about 0.06 wt. % lead and which contained: (1) no magnesium, (2) magnesium, and (3) magnesium + copper in the amounts indicated in Table I herein. A series of 20-gauge rimmed 4 × 8 inch (10.2cm × 20.4cm) steel panels were hot-dip coated with the above baths. The steel had a chemical composition as follows: about 0.08% carbon, 0.29% to 35% manganese, 0.01% to 0.011% phosphorus, 0.019% to 0.020% sulfur, and 0.04% copper, with the balance essentially iron. All the panels were precleaned by oxidizing in a furnace at 1650° F (899° C) for 30 seconds, and the oxidized panels were then transferred into a laboratory "dry box" which contained the coating baths and laboratory galvanizing equipment. The reducing atmosphere inside the "dry box" comprised 10% hydrogen with the balance nitrogen. The dew point inside the dry box was always kept below −15° F during the hot-dip coating operation. The clean panels were preheated at 1700° F (927° C) for 3 minutes in the reducing atmosphere of the dry box to effect removal of all surface oxides and then cooled while being maintained within the reducing atmosphere of the dry box to the hot-dip coating bath temperature of about 820° F (438° C). The immersion time in the coating bath for each panel was about 5 seconds to provide an average coating weight of about 0.5 oz. per sq. ft. (0.016 gr/cm$^2$). The alloy coating bath compositions and the coating appearance in the as-coated condition before exposure to a high humidity atmosphere are shown in the following Table I:

TABLE I

| Alloy Coating Bath Compositions (Wt. %) | Coating Appearance As-Coated |
|---|---|
| A. 5.0% Al-0.02% Pb-Zn | Bright, smooth, subsurface polagonal grain structure |
| B. 5.0% Al-0.05% Pb-Zn | Bright, smooth, subsurface polagonal grain structure |
| C. 5.0% Al-0.06% Pb-Zn (Fig. 1) | Bright, smooth, subsurface polagonal grain structure |
| D. 5.0% Al-0.1% Pb-Zn | Bright, smooth, subsurface polagonal grain structure |
| E. 5% Al-0.06% Pb-0.05% Mg-Zn | Slightly dull, smooth surface free of spangles and grain structure |
| F. 5% Al-0.06% Pb-0.1% Mg-Zn (Fig.2) | Slightly dull, smooth surface free of spangles and grain structure |
| G. 5% Al-0.06% Pb-0.1% Mg-0.1% Cu-Zn | Slightly dull, smooth surface free of spangles and grain structure |
| H. 5% Al-0.06% Pb-0.1% Mg-0.2% Cu-Zn | Slightly dull, smooth surface free of spangles and grain structure |
| I. 5% Al-0.06% Pb-0.1% Mg-0.3% CuZn (FIG.3) | Slightly dull, smooth surface free of spangles and grain structure |
| J. 0.2% Al - < 0.01% Pb-Zn | Bright, smooth, non-spangled surface |
| K. 0.2% Al-0.02% Pb-Zn | Bright, smooth, no significant spangles on surface |
| L. 0.2% Al-0.05% Pb-Zn | Bright, smooth, spangled surface |
| M. 0.2% Al-0.1% Pb-Zn (Fig. 6) | Bright, smooth, large spangled surface |
| N. 0.2% Al-0.1% Pb-0.05% Mg-Zn | Bright, smooth, large spangled surface |
| O. 0.2% Al-0.1% Pb-0.1% Mg-Zn | Bright, smooth, large spangled surface |
| P. 0.2% Al-0.1% Pb-0.1% Mg-0.3% Cu-Zn (Fig. 7) | Bright, smooth, large spangled surface |

The specimens of Table I were next exposed to a humid atmosphere at 176° F (80° C) and 92% relative humidity for at least 5 days and then micrographically examined under 600× to 750× magnification. FIGS. 1, 2 and 3 of the drawing show cross-sectional photomicrographs (750×) of the structure of the coated specimens C, F and I of Table I, respectively, in the unetched condition after exposure to the above humid environment. FIG. 6 of the drawing is a cross-sectional photomicrograph (600×) of the unetched coated specimen M of Table I after 2 weeks exposure at 176° F (80° C) in a 92% R. H. atmosphere. FIG. 7 of the drawing is a cross-sectional photomicrograph at 600× magnification of the unetched coated specimen P of Table I after 2 weeks exposure at 176° F (80° C) in a 92% R. H. atmosphere.

It can be seen by comparing the Figures of the drawing that the addition of 0.1% magnesium or 0.1% magnesium plus 0.3% copper has very significantly reduced the amount of intergranular corrosion in both the 0.2% aluminum and 5% aluminum lead-containing alloys of zinc-aluminum. Optimum improvement was obtained from the zinc-aluminum alloy coating bath containing 0.1 wt. % magnesium and 0.3 wt. % copper (See FIGS. 3, 5 and 7). All coatings described in Table I before storage showed good adherence properties when subjected to conventional formability tests and the studies failed to show any intergranular corrosion. After storage the coating of FIG. 1 exhibited surface blisters due to intergranular corrosion. Each of the coated panels specimen C, F and I of Table I, after the 5 day exposure to the high humidity atmosphere, was also subjected to the 120-pound (54 Kg.) Gardner-Impact Test. The test results showed no evidence of deterioration in coating adherence due to intergranular corrosion in the coatings specimens F and I, but poor adherence was exhibited by the coating panel specimen C. The coated panel specimen M exhibited blisters along spangle boundaries after exposure to a 92% R. H. atmosphere at 176° F (80° C) for 5 days, whereas there were no blisters formed in specimen spangles O and P after exposure to the same high humidity atmosphere.

The following Table II summarizes the test results and coating characteristics of the 0.2 wt. % aluminum-zinc alloy coatings of Table I after exposure for 5 days at 176° F (80° C) to a 92% R. H. atmosphere:

TABLE II

| Aluminum-Zinc Coating Bath Composition (Wt. %) | Coating Characteristics After Exposure To High Humidity Atmosphere |
|---|---|
| 0.2% Al- < 0.01% Pb-Zn (J) | No Intergranular Corrosion - No Blistering No Spangles |
| 0.2% Al-0.02% Pb-Zn (K) | No Intergranular Corrosion - No Blistering No Spangles |
| 0.2% Al-0.05% Pb-Zn (L) | Intergranular Corrosion - Very fine blisters along Spangle Boundaries - Spangles |
| 0.2% Al-0.1% Pb-Zn (M) | Intergranular Corrosion - Fine Blisters Along Spangle Boundaries - Large Spangles |
| 0.2% Al-0.1% Pb-0.05% Mg-Zn (N) | Slight Intergranular Corrosion - No Blisters - Spangles |
| 0.2% Al-0.1% Pb-0.1% Mg-Zn (O) | Very Slight Intergranular Corrosion - No Blisters - Spangles |
| 0.2% Al-0.1% Pb-0.1% Mg-0.3% Cu-Zn (P) | No Significant Intergranular Corrosion - No Blisters - Spangles |

In order to further illustrate the present invention a series of hot-dip coatings were applied to steel strips on an experimental coating line which closely simulated a Sendzimir-type continuous hot-dip galvanizing coating line wherein strips of 20 to 28 gauge full hard rimmed steel about 9 inches (22.9 cm.) wide had a chemical composition on a weight basis of about 0.04% carbon, 0.29% to 0.35% manganese, 0.01% to 0.011% phosphorus, 0.019% to 0.020% sulfur and 0.04% copper with the balance being essentially iron. The aluminum-zinc eutectic alloy hot-dip coating baths contained as alloy additions of at least 0.06 wt. % and a maximum of 0.15% by wt. lead and either (1) 0.1% by wt. magnesium or (2) 0.1% by wt. magnesium + 0.3% by wt. copper. Each hot-dip coating bath was prepared by heating a quantity of pre-formed 5 1 wt. % aluminum-zinc eutectic alloy in an induction heated gray cast iron pot at a temperature of about 825° F (440° C) to form a coating bath which contained 5% ± 0.5 wt. % aluminum with the balance comprising essentially of zinc saturated with iron (0.02 wt. %) and the above indicated amounts of lead, magnesium and copper. The steel strips to be continuously coated were passed through a controlled atmosphere in which the surface contaminants were burned off and the surface of the strip reduced in a hydrogen atmosphere to remove surface oxides, generally in accordance with a conventional Sendzimir process. The strips, in the alternative, could have been chemically cleaned by means of an alkaline cleaning bath. The clean strips at a temperature of about 830° F (443° C) were then passed continuously through one of the above alloy coating baths designated (1) or (2) at a rate of between about 30 to 60 ft. (9.1 m to 18.3 m) per minute with a dwell time in the bath between about 4 and 8 seconds. Steam at a temperature of 900° F (482° C) or nitrogen at room temperature (i.e. cold $N_2$) was impinged upon the coating as the strips were removed from the coating bath to control the thickness of the hot-dip coating to about 0.5 ounce (14.2 gm) per sq. ft. (929 $cm^2$) for general coil coating and to a coating weight of 1.0 ounce (28.4 gm.) per sq. ft. (929 $cm^2$) for culvert stock coils. The strips were air quenched, and the hot-dip coatings had a smooth bright appearance with no spangles being evident. A control was run in a like manner with a similar coating bath but without the magnesium or copper additions (See FIG. 4 of drawing). All coatings contained 0.06 wt. % lead.

All the coatings produced in the above manner showed good coating adherences immediately after the coating run based on standard formability tests. However, when these coatings were re-examined about 1 year later, the 5 wt. % Al-Zn coating without the magnesium addition showed a deterioration in coating adherence. Micro-examination of the coating structure (See FIG. 4) showed that intergranular corrosion had developed during the 1 year storage period. The intergranular corrosion test results for four representative specimens produced in the above-described manner are shown in Table III:

TABLE III

| Coating Composition (Wt. %) | Condition of Coating After Storage |
|---|---|
| 5% Al-0.06% Pb-Zn coating on 28 gauge strip (preheated steam used to control coating thickness). | Intergranular corrosion, mostly perpendicular to steel base indicating preferred orientation of the grains after 15 months indoor storage. |
| 5% Al-0.06% Pb-Zn coating on 28 gauge strip (cold $N_2$ impingement used to control thickness). | Intergranular corrosion, no sign of preferred grain orientation after 15 months indoor storage (See Fig. 5). |
| 5% Al-0.06% Pb-0.1% Mg-Zn coating on 28 gauge strip (cold $N_2$ impingement). | No significant intergranular corrosion after 12 months indoor storage. |
| 5% Al-0.06% Pb-0.1% Mg-0.3% Cu-Zn coating on 28 gauge strip (cold $N_2$ impingement). | No intergranular corrosion after 12 months indoor storage. Inside Warehouse for 12–15 Months. |

It can be seen from Table III that the 5 wt. % aluminum-zinc coatings containing 0.06 wt. % lead and 0.1 wt. % magnesium or both 0.1 wt. % magnesium plus 0.3 wt. % copper show no significant intergranular corrosion after prolonged indoor storage.

A series of zinc-aluminum alloys containing various amounts of lead and with a 10% and 15% by wt. aluminum concentration were made and evaluated in the laboratory. The compositions of these alloys are tabulated in Table IV. All of these alloys were prepared by adding pure alloying elements to pure zinc spelter which was saturated with iron (0.02 wt. % Fe). These alloys were then exposed for 6 days to a hot (80° C) and humid air environment having 92% relative humidity and evaluated with regards to their resistance to intergranular corrosion. The test results are given in the following Table IV:

TABLE IV

| Composition of alloy (Wt. %) | Appearance After Exposure* |
|---|---|
| 10% Al-max. 0.02% Pb-Zn | No cracks |
| 10% Al-0.05% Pb-Zn | Slightly cracked |
| 10% Al-0.1% Pb-Zn | Severely cracked |
| 10% Al-0.1%-Pb-0.1% Mg-Zn | No cracks |
| 10% Al-0.1%-Pb-0.1% Mg-0.3% Cu-Zn | No cracks |
| 10% Al-0.15%-Pb-0.1% Mg-0.3% Cu-Zn | No cracks |
| 15% Al-max. 0.02% Pb-Zn | No cracks |
| 15% Al-0.05% Pb-Zn | Slightly cracked |
| 15% Al-0.1% Pb-Zn | Cracked |
| 15% Al-0.1% Pb-0.1% Mg-Zn | No cracks |
| 15% Al-0.1% Pb-0.1% Mg-0.3% Cu-Zn | No cracks |
| 15% Al-0.15% Pb-0.1% Mg-0.3% Cu-Zn | No cracks |

*6 days at 176° F (80° C) in 92% R. H. atmosphere.

The test results summarized in Table IV indicate that the 10% aluminum-zinc and the 15% aluminum-zinc alloys with a lead content ranging from 0.05 wt. % and above were susceptible to intergranular corrosion when exposed to a hot humid atmosphere, but when 0.1 wt. % magnesium or a combination of 0.1 wt. % magnesium and 0.3 wt. % copper were added to the zinc-aluminum alloys, the intergranular corrosion, as evidenced by cracks forming in the surface, was no longer evident.

Whereas the improved aluminum-zinc alloy coatings in the herein described preferred embodiments were made by the hot-dip process, any other suitable process for applying the improved alloy coating to a ferrous metal can be used, such as by spray coating, and powder metallurgy.

I claim:

1. A ferrous metal sheet having on a surface thereof a zinc-aluminum alloy continuous hot-dip coating which is resistant to intergranular corrosion and which has a composition consisting essentially of between 0.2 wt. % and about 17 wt. % aluminum, between about 0.06 wt. % and about 0.15 wt. % lead, and about 0.1 wt. % magnesium with the balance being essentially zinc, and said alloy coating being characterized by a smooth ripple-free surface and the absence of blistering along grain boundaries and separation of the said coating from said sheet when said ferrous metal sheet is subjected to conventional formability tests after prolonged storage in a high humidity atmosphere.

2. A ferrous metal sheet as in claim 1, wherein said alloy continuous hot-dip coating contains between about 0.1 wt. % and 0.3 wt. % copper.

3. A ferrous metal sheet having a hot-dip coating as in claim 1, wherein said alloy continuous hot-dip coating contains between about 4 wt. % and about 17 wt. % aluminum.

4. A ferrous metal sheet having a hot-dip coating as in claim 1, wherein said alloy continuous hot-dip coating contains about 5 wt. % ± 0.5 wt. % aluminum.

5. A ferrous metal sheet as in claim 1, wherein said alloy continuous hot-dip coating consists of about 5 wt. % aluminum, about 0.1 wt. % lead, and about 0.1 wt. % magnesium with the balance essentially zinc.

6. A ferrous metal sheet as in claim 1, wherein said alloy continuous hot-dip coating has a bright spangled surface and consists of about 0.2 wt. % aluminum, about 0.1 wt. % lead, and about 0.1 wt. % magnesium with the balance essentially zinc.

* * * * *